US006024635A

United States Patent [19]

Cruickshank et al.

[11] Patent Number: 6,024,635

[45] Date of Patent: Feb. 15, 2000

[54] ROTARY DRUM TOOL

[75] Inventors: E. J. Cruickshank, Elk River; Thomas Alvin Walesch, St. Louis Park, both of Minn.

[73] Assignee: Specialty Sales, Inc., Maple Grove, Minn.

[21] Appl. No.: 08/755,483

[22] Filed: Nov. 22, 1996

[51] Int. Cl.[7] ..... B34D 5/06

[52] U.S. Cl. ..... 451/541; 451/543; 451/547

[58] Field of Search ..... 451/541, 542, 451/543, 544, 546, 547, 61, 180

[56] References Cited

U.S. PATENT DOCUMENTS

| | | | |
|---|---|---|---|
| Re. 22,457 | 3/1944 | Jeppson et al. | 451/543 |
| 398,806 | 2/1889 | Sykes | 451/543 |
| 1,828,740 | 10/1931 | Legge | 451/543 |
| 2,141,608 | 12/1938 | Larsson | 451/542 |
| 2,284,134 | 5/1942 | Connor | 451/156 |
| 2,313,442 | 3/1943 | Kline | 451/156 |
| 2,421,886 | 6/1947 | Howe et al. | 451/541 |
| 2,887,276 | 5/1959 | Minarik | 451/543 |
| 3,510,990 | 5/1970 | Steindler | 451/541 |
| 5,052,154 | 10/1991 | Lehmann | 451/542 |

*Primary Examiner*—Eileen P. Morgan
*Attorney, Agent, or Firm*—Moore & Hansen

[57] ABSTRACT

A rotatably mounted tool for surface working of construction blocks, e.g. concrete or granite blocks, as well as roadways, incorporates a plurality of flat, planar surfaces which are circumferentially spaced apart around the outer, peripheral surface of the generally cylindrical tool drum. A plurality of abrasive mounting shoes are removably secured to the flat drum surfaces, with flat surfaces on the shoes evenly seated in conforming relation to the flat drum surfaces. Abrasive segments are selectively affixed to each mounting shoe in a desired number, size, and spacing to carry out the desired surface working operation, i.e., cutting grooves in road surfaces or smooth finishing concrete blocks. The arrangement and orientation of the abrasive mounting shoes on the tool drum may also be varied in order to achieve full work surface coverage for particular applications.

14 Claims, 3 Drawing Sheets

ROTARY DRUM TOOL

BACKGROUND OF THE INVENTION

This invention relates to grinding tools, and especially to rotatably mounted tools carrying abrasive segments particularly adapted for surface working of materials such as concrete, granite, and marble.

Such types of grinding tools have been commonly employed for the smooth finishing of exposed concrete blocks used in building construction, as well as for grinding and texturing road pavement surfaces. For concrete block applications, the grinding tool is shaft-mounted in a machine to position its peripheral abrasive surface for rotary, working contact with concrete blocks which are moved past the tool. In road surfacing applications, the tool is rotatably supported on a vehicle which traverses the road surface. For drainage and friction enhancement, road surfaces are grooved or textured.

The aforesaid different applications require mounting the abrasive segments in different spacing and pattern arrangements. See, for example, U.S. Pat. No. 5,083,839 to Younger. U.S. Pat. Nos. 3,324,603 and 3,324,607 to Niemiec also disclose rotary grinding tools with peripherally mounted abrasive segments for surface working of concrete and the like.

However, the tools of Younger and Niemiec present problems in manufacture and assembly and are limited as to the spacing and orientation of abrasive segment mounting for suitable use in varied applications ranging from smooth finishing to grooving. The abrasive segments themselves and/or their mounting bands as disclosed by Younger and Niemiec are of circular or curvilinear shape and are mounted circumferentially around a cylindrical drum. With such constructions, it is extremely difficult to precisely machine a curved surface on an abrasive segment or its mounting band so as to precisely conform to the curvilinear surface of a cylindrical mounting drum. Unavoidable mismatches in such machining and assembly operations cause uneven contact of the abrasive segments or their mounting bands with the support drum, with resultant loose fitting and undesired vibration of the abrasive segments.

With this background in mind, an improved, rotary grinding tool has been developed which overcomes the aforesaid problems associated with prior art tools of the type described.

BRIEF SUMMARY OF THE INVENTION

This invention has as its primary objective the manufacture of a rotary tool so as to removably mount shoe members supporting abrasive segments on a rotary drum in a solid, stable, vibration-free manner.

A further objective is to carry out the aforesaid grinding tool manufacture in efficient and minimally complex machining and assembly operations.

Another objective is to achieve maximum variation in the type of grinding, surface finishing, and grooving applications for which a single, machined, abrasive-supporting drum may be utilized.

These basic objectives are realized by machining a plurality of flat, planar surfaces in the outer peripheral surface of a metallic drum of generally cylindrical configuration, with the flat surfaces being spaced apart around the circumference of the drum and extending generally lengthwise of the drum and substantially parallel to its longitudinal axis of rotation. This drum construction permits a plurality of abrasive mounting shoes having flat bottom surfaces to be evenly seated in conforming relation to the flat drum surfaces. Preferably, the mounting shoes are securely and removably affixed to the drum by bolts extending therethrough into threaded engagement with the drum.

Each mounting shoe supports one or more abrasive segments, each of which has a curvilinear outer surface, with those surfaces oriented to define together a working pattern of generally cylindrical configuration for performing a desired grinding, finishing, or grooving operation. Preferably, the drum is machined from solid bar stock to provide a solid, stable, vibration-free mounting for the abrasive segments.

As a particularly advantageous feature, a plurality of abrasive segments are secured to each mounting shoe; and the number, size, and spacing of the abrasive segments on the separate mounting shoes can be varied, as well as their arrangement pattern and orientation on a cylindrical drum, so as to provide full flexibility of surface working desired. For example, the abrasive segments may be narrow and spaced apart on each mounting shoe so as to cut grooves in a surface, such as a roadway. Alternatively, the abrasive segments may be arranged to abut each other on each mounting shoe to form a continuous abrasive section, and with the shoes secured on the cylindrical drum to provide an abrasive pattern which will accomplish uniform abrasive coverage over a work surface in a smooth or fine finishing operation.

As a further advantageous feature, particularly for smooth finishing, the individual abrasive segments may be shaped and positioned to extend at an obtuse angle to the longitudinal direction of extent of each mounting shoe, and thus at an obtuse angle to the longitudinal axis of rotation of the drum. Also, the angle of the abrasive segments may be alternated in adjacent rows of mounting shoes. These features enhance work surface coverage and minimize drum wear.

These and other objects and advantages of the invention will be readily understood as the following written description is read in conjunction with the accompanying drawings wherein like reference numerals have been utilized to designate like elements throughout the several views.

DESCRIPTION OF THE PREFERRED EMBODIMENTS

Figure 1:
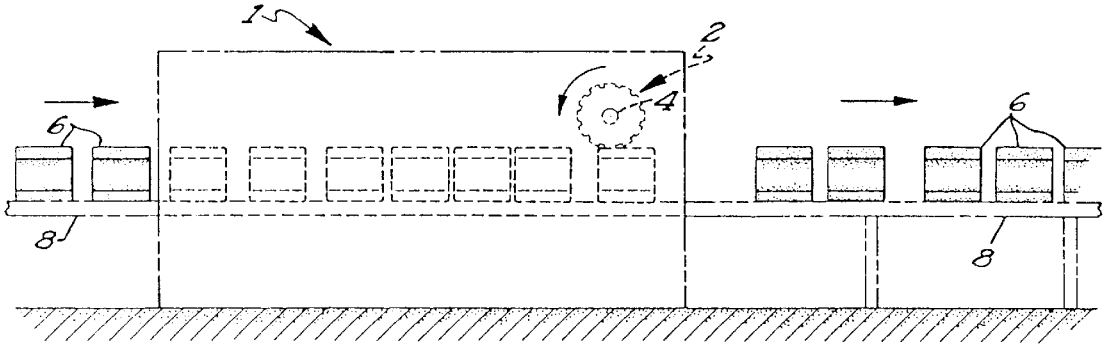
FIG. 1 is a side elevation view, in schematic form, showing a block finishing machine using the tool of this invention.

FIG. 1 illustrates a machine 1 in which the rotary drum tool 2 of this invention may be utilized as shown to machine the surfaces of concrete blocks. In such an application, the tool 2 is mounted horizontally for rotation about its longitudinal axis as defined by a rotary mounting shaft 4. Blocks of concrete or other material to be finished, such as granite or marble, are transported on a conveyor 8 in the direction shown by the arrow through the machine 1 and under the rotary tool 2. The tool rotates in the direction shown by its arrow so that its peripheral surface of abrasive segments, as described in detail below, may be brought into working contact with the top surface of blocks 6 to provide a desired, finished surface. For such a smooth, finishing operation on concrete blocks, for example, the tool 2 would carry abrasive segments on a plurality of mounting shoes in an arrangement as described below with respect to FIGS. 6–8.

Figure 9:
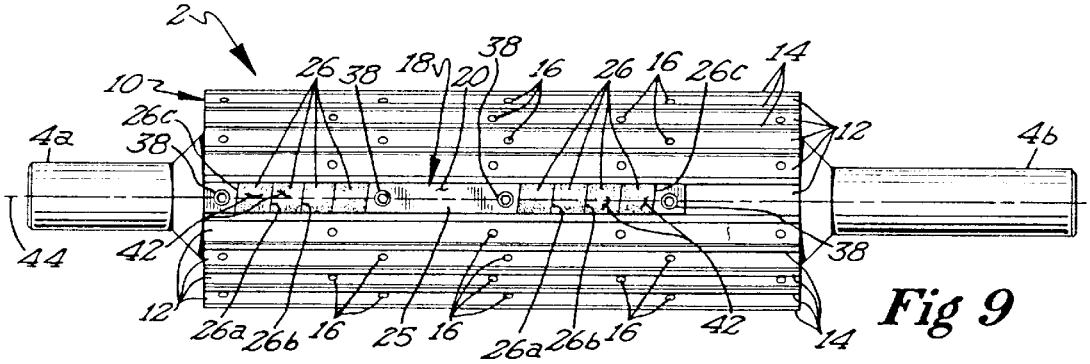
FIG. 9 is a side elevation view of the tool drum of this invention, with tapped holes provided to receive mounting shoes as shown in FIGS. 6–8.

The preferred embodiment of the tool is illustrated in FIG. 9. As shown, the tool 2 is comprised of a generally cylindrical, elongated drum 10, which is preferably formed to provide stub shafts 4*a* and 4*b* at its opposite ends. In the preferred embodiment, the rotary tool is machined from a single piece of solid steel bar stock, with the ends turned down to form stub mounting shafts 4*a* and 4*b*. Those stub shafts permit the tool to be mounted in a machine 1 as illustrated in FIG. 1, for rotational movement about its longitudinal axis defined by shafts 4*a*, 4*b*. Alternatively, the drum tool may be mounted in a road surfacing machine carried on a vehicle which traverses the road surface. Such a road surfacing machine could be of the type, for example, as shown in U.S. Pat. No. 3,874,806.

Cylindrical drum 10 is preferably machined, as by milling, to provide a plurality of flat, planar surfaces 12 formed in its outer peripheral surface in spaced apart relation as shown in FIG. 9. Each of those flat, planar surfaces is separated by an unmilled portion of the drum so as to provide upstanding ribs 14 which separate the flat surfaces 12. The drum is drilled and tapped to provide a plurality of threaded apertures 16 utilized to receive attachment bolts for abrasive mounting shoes as hereinafter set forth.

Figure 2:
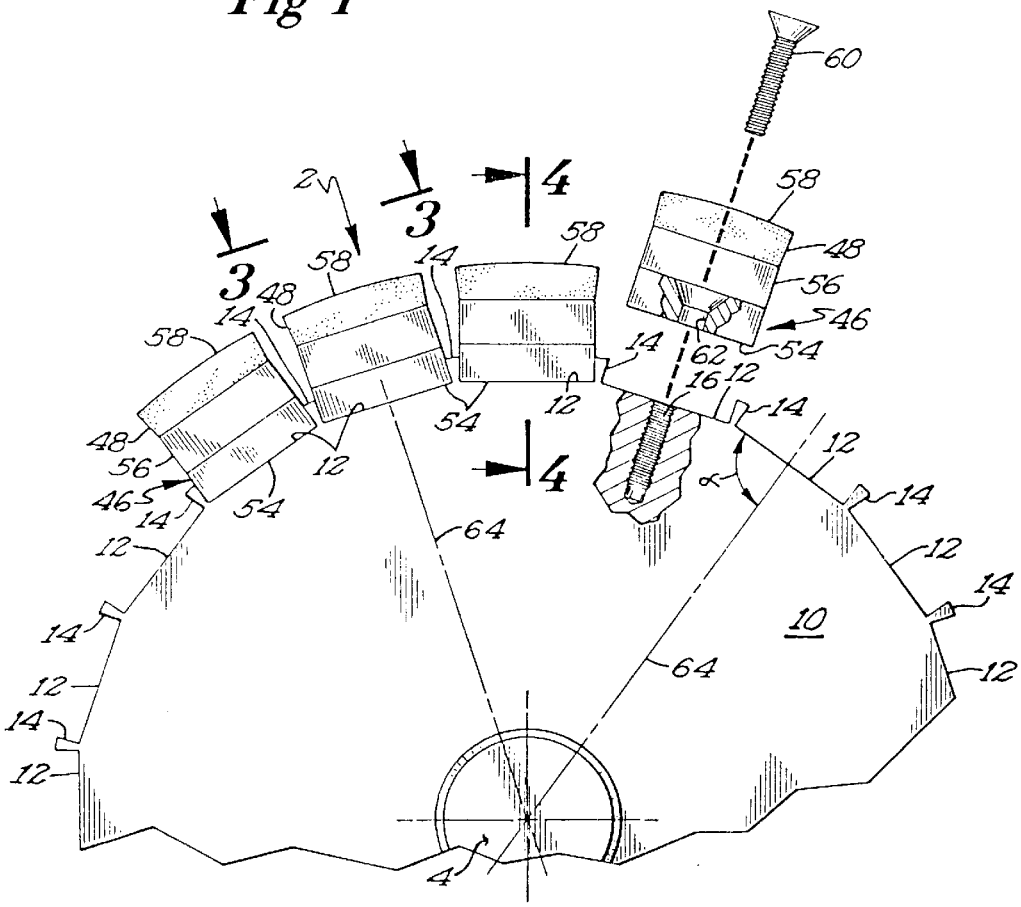
FIG. 2 is an end view of the tool of FIG. 1, partially broken away and exploded to show the assembly of abrasive mounting shoes to the tool drum.
Figure 8:
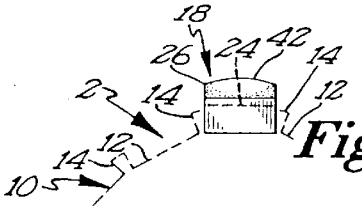
FIG. 8 is an end elevation view of the mounting shoe and abrasive segment assembly of FIGS. 6 and 7, shown schematically on a tool drum.

The drum 10, with its milled, flat surfaces 12 and upstanding ribs 14, appears in an end view as shown in FIGS. 8 and 2. However, as described below, although the basic drum configuration remains the same, different types of mounting shoes and abrasive segment assemblies may be mounted on the drum for different applications as illustrated with respect to FIGS. 2 and 8.

Figure 6:
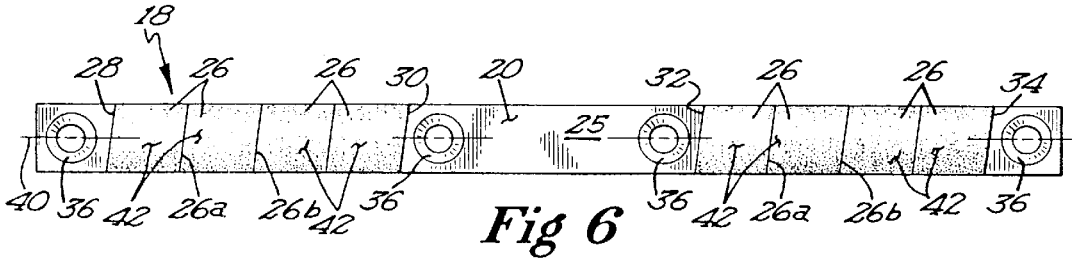
FIG. 6 is a top, plan view of an alternative embodiment of a mounting shoe and abrasive segment assembly for smooth or fine finishing.
Figure 7:
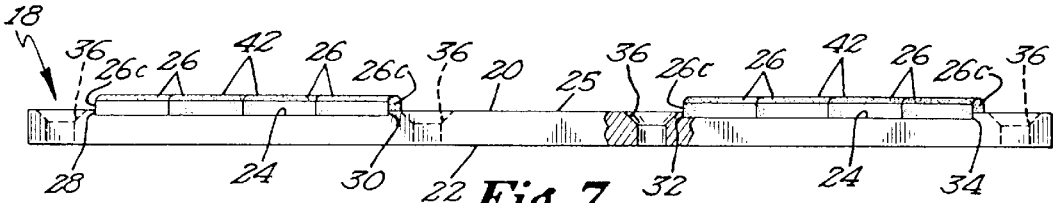
FIG. 7 is a side elevation view of the mounting shoe and abrasive segment assembly of FIG. 6.

One embodiment of a mounting shoe and abrasive segment assembly is shown in FIGS. 6–8.

The abrasive mounting shoe 18 is preferably elongated and of generally rectangular shape as shown. Each such mounting shoe has a top face 20 and a flat bottom face 22 for flush, even seating on flat, milled surfaces 12 of drum 2. For the purpose of mounting and supporting abrasive segments 26, the top surface 20 of mounting shoe 18 is machined to provide recesses 24, the opposite ends of which are defined by shoulders 28, 30 and 32, 34. Holes 36 for receiving threaded bolts 38 utilized to affix the mounting shoes in tapped bolt hole 16 of drum 2 are provided as shown, through mounting shoes 18 at spaced-apart locations thereon, and at least at the opposite ends of each mounting shoe 18. In the embodiment shown in FIGS. 6 and 7, each of the mounting shoes 18 is sized and shaped to receive a plurality of abrasive segments 26 secured to its top surface, as by silver soldering, welding, or appropriate adhesive, the mounting shoes being preferably made of steel. The abrasive segments 26 as shown in FIGS. 6 and 7 are abutted against each other to provide continuous abrasive sections along the length of shoes 18 as shown. In this particular embodiment of the mounting shoe and abrasive segment assembly, a blank space 25 is provided substantially midway of the length of shoe 18 on its top surface 20. This is done to achieve a particular pattern of abrasive segment orientation on the drum as hereinafter set forth.

Typically, the abrasive segments 26 will be comprised of diamond chips distributed in a metallic matrix in a sintering process. Other types of abrasive materials and abrasive segments may be utilized, depending upon the particular application and surface to be worked.

As shown in FIGS. 6 and 7, the abrasive segments 26 are of angled, rectilinear configuration, and shoulders 28, 30, 32, and 34 are formed on the recesses 24 of mounting shoe 18 at an identical angle. Thus, the abrasive segments 26 at the ends of each recess 24 will tightly abut against one of those angled shoulders in conforming relation thereto, as most clearly shown in FIG. 6. Thus, the side edges 26*a*, 26*b* of each abrasive segment 26, as well as the shoulders 28, 30, 32, and 34 defining the ends of recesses 24 extend at an obtuse angle theta to the longitudinal center line 40 of shoe 18, as shown in FIG. 6. That angle is not critical. In the embodiment as shown the angle theta is on the order of 95° to 100°. The use of angled abrasive segments is not essential; however, angled abrasive segments do provide advantages in achieving complete, uniform abrasive segment coverage of the drum and thus of the surface being worked by the tool, as well as avoiding undesired wear patterns on the drum. Those features are discussed below with respect to the distribution pattern of a plurality of the mounting shoes 18 on a drum as discussed and illustrated with respect to FIGS. 9 and 10.

FIG. 8 shows a vertical, end view of one of the mounting shoe and abrasive segment assemblies of FIGS. 6–7, as diagrammatically illustrated in place on the drum tool 2. Each of the abrasive segments 26 is formed to provide a curvilinear top surface 42, with those top surfaces on adjacent shoes 18 as mounted circumferentially around the periphery of a drum 2 defining together a generally cylindrical configuration having the same direction of curvature as that of the outer, peripheral surface of the cylindrical drum. This provides the desired, smooth contact of the abrasive surfaces 42 with the face of the block or pavement which is being worked or finished.

With reference to FIGS. 8 and 9, the flat, planar surfaces 12 are machined to extend generally lengthwise of the elongated drum 2 and thus substantially parallel to its longitudinal axis of rotation 44. Shoes 18 are removably secured on flat surfaces 12, with their flat, bottom surfaces 22 lying flat and evenly on the milled flat surfaces 12. Thus, the elongated shoes 18 are seated in conforming relation against the drum flat surfaces 12 between upstanding ribs 14. FIG. 9 illustrates one of the shoes 18 positioned in place on one of the flat surfaces 12, and secured to the drum by mounting bolts 38 extending through apertures 36 in the shoe and threaded into tapped holes 16 formed in drum 2. This same shoe mounting arrangement on the drum is illustrated with respect to a different embodiment of a mounting shoe and abrasive segment assembly as illustrated in FIGS. 2–4.

Figure 10:
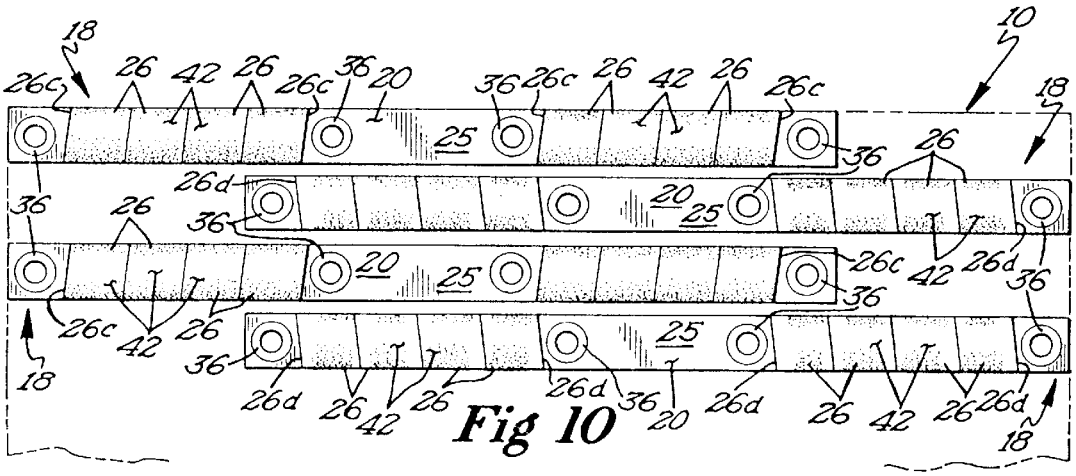
FIG. 10 is a diagrammatic showing of a pattern of mounting shoes of the type illustrated in FIGS. 6–8, as would appear on the drum of FIG. 9 in a flattened condition.

Different sizes and shapes of abrasive mounting shoes 18 may be utilized, and arranged in different patterns on drum 2 to achieve the desired, full abrasive surface coverage of the block or pavement being finished or grooved. The mounting shoe 18 of FIGS. 6–8 may be on the order of 13 to 15 inches in length with a height of about one-half inch, excluding the abrasive segments attached to its top face. Such shoes may have a width of, for example, one inch, which will generally conform to the circumferential spacing between ribs 14 on drum 2. The drum is drilled with tapped holes 16 in a desired pattern, to accomplish the mounting of shoes 18 on the drum in a particular array. The drum 2 may have a length on the order of 20 inches to accommodate shoes 18 of the aforesaid size in a desired pattern. An example of such a pattern is illustrated in FIG. 10. In order to provide complete abrasive surface coverage around the peripheral surface of the drum, and thus uniform and complete working of the surface of concrete blocks or other material, the shoes 18 are staggered in their longitudinal positioning along the length of the drum, as shown in FIG. 10, to overlap each other, with two adjacent shoes 18 being required to cover the entire length of the drum. The shoes are located and overlapped as shown, so that the abrasive segments 26 on one shoe will be adjacent the blank segment 20 of an adjacent shoe, so as to insure complete abrasive coverage. The angling of the abrasive segments 26, as described above, is advantageous in avoiding the presentation of leading edges on the abrasive segments which could form an undesired wear pattern on the drum and abrasive segments. To further insure that such uneven wear does not occur, the shoes 18 are oriented on the drum so that the abrasive segments 26 of adjacent shoes will be angled in opposite directions, as illustrated in FIG. 10. This accomplishes an overlap of angled end faces 26*c* and 26*d* of adjacent abrasive segments 26 in adjoining rows of shoes 18, as shown in FIG. 10 to assist in avoiding a wear line or pattern on the drum. With the size, shape, and arrangement of mounting shoes 18, with the closely abutting abrasive segments 26 as illustrated in FIG. 10, the finishing of surfaces, e.g., of concrete blocks as illustrated with respect to FIG. 1, can be effectively accomplished. With a drum on the order of 19–20 inches long on its working surface, and having a diameter on the order of seven inches, 20 shoes 18 carrying abrasive segments 26 in the arrangement of FIGS. 6–8 would be required to cover the entire peripheral circumference of the drum. Finer finishing of surfaces, such as of concrete blocks, may be accomplished by utilizing an increased number of abrasive segments spaced and arranged on the mounting shoes in different modes. Such mounting shoes may also be spaced and arranged in different patterns on the outer surface of the tool drum 2. In other words, the size, shape, arrangement, and orientation of the mounting shoes and abrasive segments may be varied as desired to obtain the desired surface finish.

Figure 3:
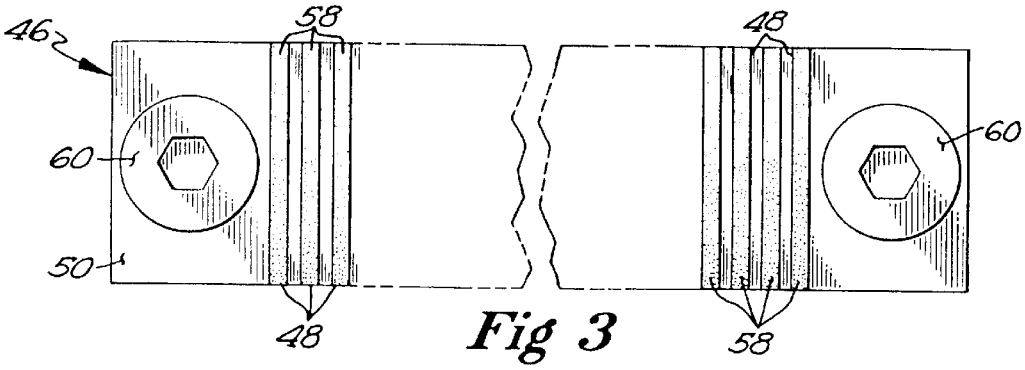
FIG. 3 is a top, plan view of one embodiment of a mounting shoe and abrasive cutter head assembly, taken along lines 3—3 of FIG. 2.
Figure 4:
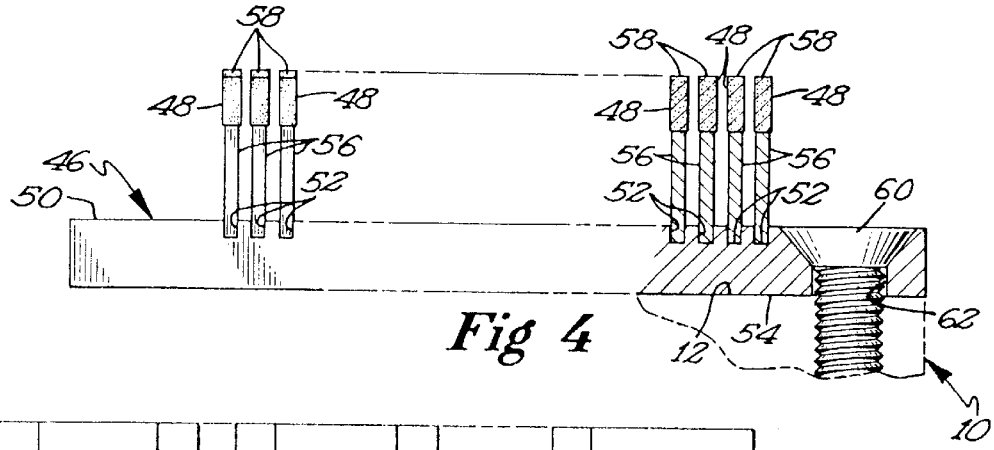
FIG. 4 is a side elevation view, partially in section, of the mounting shoe and cutting head assembly of FIG. 3, and taken along lines 4—4 of FIG. 2.

FIGS. 2, 3, and 4 illustrate an alternative embodiment of mounting shoe and abrasive segment assembly. As shown particularly in FIGS. 3 and 4, the mounting shoe 46 is elongated and of generally rectangular shape and serves to support a plurality of abrasive segments or cutting heads 48 which project outwardly from its top face 50. For that purpose, top face 50 is machined to provide a plurality of grooves or slots 52 which are also of generally rectangular shape. The bottom face 54 of mounting shoe 46 is flat and planar. The abrasive segments or cutting heads 48 are preferably supported on base plates in the form of steel shims 56, to which abrasive segments 48 are preferably securely mounted by laser welding. Like the abrasive segments 26 of FIGS. 6–8, abrasive segments 48 also comprise diamond particles or chips contained within a metal matrix. Steel shim plates 56 are securely mounted within slots 52 of shoes 46 by a laser welding process. In this way, the abrasive elements 48 are solidly and securely mounted on shoes 46.

Each of the shoes 46 also has drilled holes 62 extending vertically through its opposite ends. Bolts 60, which as shown may comprise socket head, threaded fasteners are inserted through shoe apertures 62 into threaded engagement with threaded holes 16 in tool drum 2. By this mounting procedure, as illustrated in FIG. 2, each of a plurality of mounting shoes 46 is securely attached to the peripheral, outer surface of a tool drum 2. The same, basic tool drum structure and configuration as described above with respect to FIGS. 8 and 9 may be utilized to receive the mounting shoes 46, as well as the above-described mounting shoes 18. Elongated shoes 46 are positioned between adjacent ribs 14 on drum 2 so as to bring the flat surface 54 of each shoe 46 into flush, even contact with flat, milled surfaces 12 extending longitudinally along the surface of drum 10. FIG. 2 illustrates in an exploded, fragmentary view the mounting attachment of one of the shoes 46 to drum 10, utilizing threaded fasteners 60.

It is to be noted, with respect to FIG. 2, that the flat, planar surfaces 12 machined along the length of tool drum 2, parallel to its longitudinal axis of rotation, are formed so as to preferably extend at an angle A of 90° with respect to radial lines 64 extending through the center of drum 10. This geometry of drum construction insures a symmetrical and stable arrangement of a plurality of abrasive carrying drums around the drum peripheral surface. With the shoes 46 so mounted, the curvilinear top surfaces 58 of each abrasive segment 48 will define together a generally cylindrical configuration having the same direction of curvature as that of the outer, peripheral surface of cylindrical drum 10.

As illustrated in FIGS. 3 and 4, abrasive segments or cutting heads 48 are mounted parallel to each other in a spaced-apart arrangement along the length of shoe 46. Such an arrangement of abrasive segments permits them to function as cutting heads for grooving surfaces, such as concrete pavement. For such applications, the tool drum 10 would be mounted for rotation about its stub shafts 4, along its longitudinal axis 44 as shown in FIG. 9 on a road surfacing vehicle. As the vehicle traverses a roadway, the rotation of tool drum 10 permits the abrasive segments 48 to cut grooves or a textured surface in the road surface for providing enhanced friction with wheel vehicles and/or for drainage purposes. A rotary tool drum for such a purpose may have a length of from three to four feet, and a diameter on the order of 12 inches.

Mounting shoes 46 can be given various shapes and dimensions. By way of example, the mounting shoe 46 of FIGS. 2–4 may have a width of 1–¾ inches and a height of one-half inch, with slots 52 machined to a depth of about one-eighth inch to properly support abrasive segments 48 on their base plates 56.

As noted above, the same tool drum construction may be utilized to support abrasive mounting shoes of various sizes and shapes, including the shoe 18 construction of FIGS. 6–8, as well as the shoe 46 of FIGS. 2–4. If desired, the flat surfaces 12 may be milled or machined to different widths along the length of the tool drum 10 to accommodate different widths of mounting shoes. For fine, smooth finishing of concrete blocks and roadway surfaces, abrasive segments will normally be mounted in abutting contact with each other as shown in FIGS. 6 and 7 to provide continuous, abrasive sections along the lengths of mounting shoes. For cutting or grooving surfaces, such as roadways, the abrasive segments will be mounted in spaced apart relation along the top of a mounting shoe as illustrated with respect to abrasive segments 48 on mounting shoe 46 of FIGS. 3 and 4. Thus, the tool drum and abrasive mounting shoe construction and assembly as described herein provides a great flexibility in adapting the same tool drum for a variety of grinding, grooving, finishing, and texturing operations on construction blocks and roadways of various materials. Not only may the size, shape, spacing, and number of abrasive segments be varied on mounting shoes of different sizes and shapes, but also the pattern of mounting shoe disposition on the tool drum, and thus the pattern of abrasive segments, may be varied as desired in order to accomplish the desired, full coverage, working of different types of surfaces, including concrete, marble, and granite. No matter what the application, the flat, flush mounting of the flat bottom faces 22 and 54 of the mounting shoes on the flat, planar surfaces 12 machined on the tool drum provides a very solid, stable mounting for the abrasive segments, which minimizes vibration and insures uniform finishing of work surfaces.

Figure 5:
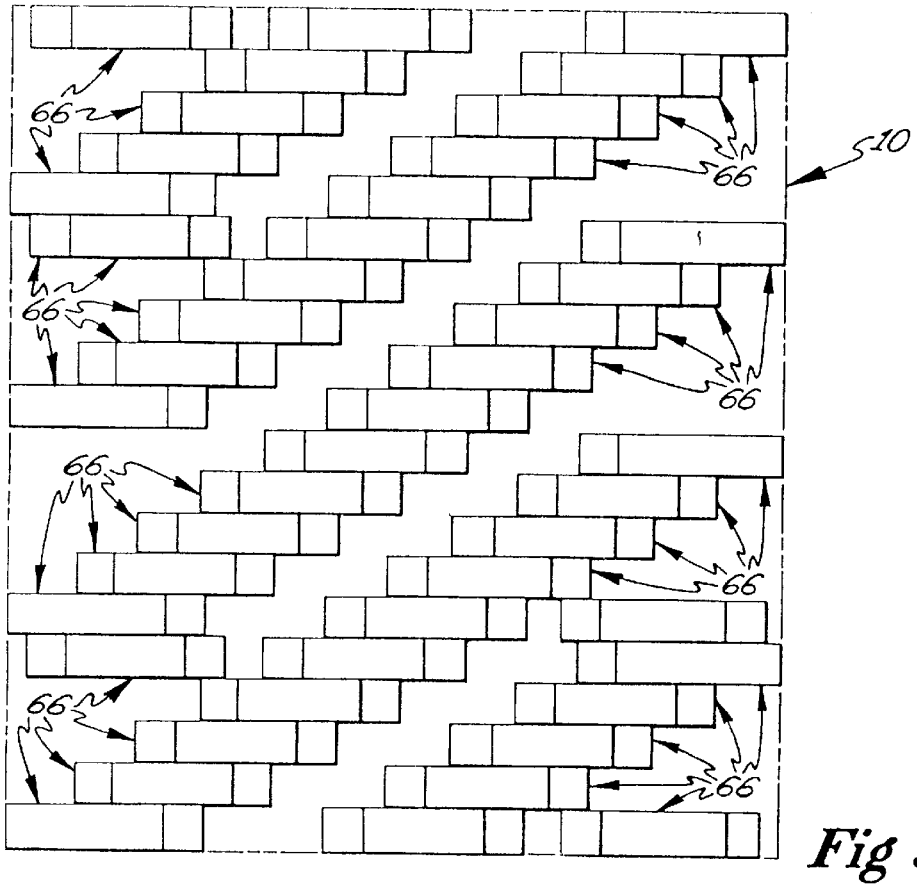
FIG. 5 is a schematic illustration of a pattern of mounting shoes as shown on a cylindrical tool drum that has been flattened to show its "foot print" from a single revolution.

The abrasive mounting shoes may be bolted to the tool drum in a variety of patterns and arrays which will provide the uniform, abrasive coverage of the work surface, and achieve the desired texture or finish. For some applications, a spiral array of mounting shoes as shown in FIG. 5 can be effective. As illustrated in FIG. 5, the mounting shoes 66 are apertured at their opposite ends to receive two attachment bolts. Such mounting shoes may be adapted to carry a plurality of abrasive segments continuously abutting each other for smooth, fine finishing, such as the finishing sometimes required on concrete construction blocks. Alternatively, mounting shoes as illustrated at 46 supporting a plurality of spaced apart abrasive segments 48 may be disposed in the array of FIG. 5 for grooving or texturing surfaces, such as roadway surfaces. FIG. 5 illustrates a cylindrical drum 10 in the condition it would assume if cut along its length and flattened out. In other words, FIG. 5 shows an example of a "footprint" which would be provided by a single revolution of a drum having a pattern of mounting shoes 66 as illustrated. Such a pattern is comprised of five rows of mounting shoes 66, carrying abrasive segments, with the rows being angled to provide a spiral-like configuration. For purposes of mounting shoe pattern illustration, the spacing between adjacent rows of shoes which would normally be provided by the upright ribs 14 has not been shown in FIG. 5.

It is to be understood that the rotary drum tool as illustrated and described may be modified in various respects, particularly with changes in the size, shape, and orientation of both the abrasive segments and the shoes on which they are mounted, as well as the pattern of disposition of the mounting shoes on cylindrical drums, without departing from the spirit and scope of the invention as defined by the following claims.

What is claimed is:

1. A tool for grinding surfaces of concrete and the like comprising:

a metal drum of generally cylindrical configuration adapted to be mounted for rotation about its longitudinal axis and having an outer, peripheral surface of generally cylindrical shape:

a plurality of flat, planar surfaces formed in the outer, peripheral surface of the drum in spaced apart relation to each other;

a plurality of mounting shoes solidly and removably secured in fixed positions on the flat planar surfaces, and each of said mounting shoes having a top face and a flat bottom face seated in conforming relation against one of said flat surfaces, said mounting shoes having apertures extending therethrough and the metal drum having holes machined therein within which removable fasteners extended through said mounting shoe apertures are received and attached;

a plurality of abrasive segments affixed to the top face of each of said mounting shoes, whereby mounting shoes having different special arrays of abrasive segments thereon may be selectively secured to the drum for different surface working applications; and the drum is elongated, and the plurality of flat, planar surfaces are formed to extend generally lengthwise of the drum and substantially parallel to its longitudinal axis of rotation, and the mounting shoes have a longitudinal direction of extent defining a length substantially parallel to the drum longitudinal axis.

2. A tool as defined in claim 1 wherein:

said abrasive segments have an outermost, curvilinear surface, with said curvilinear surfaces defining together a generally cylindrical configuration spaced radially outwardly from the outer, peripheral surface of the cylindrical drum.

3. A tool as defined in claim 1 wherein:

the abrasive segments on each mounting shoe abut each other to define a continuous abrasive surface along at least a portion of the length of each mounting shoe.

4. A tool as defined in claim 1 wherein:

said abrasive segments are spaced apart from each other along the length of each mounting shoe to form gaps therebetween, whereby a textured or grooved surface may be formed on a concrete surface by the rotation of the drum.

5. A tool as defined in claim 1 wherein:

said abrasive segments are of generally rectilinear shape as viewed from the top, with each of said segments extending at an obtuse angle to the longitudinal direction of extent of each mounting shoe, and thus at an obtuse angle to the longitudinal axis of rotation of the drum.

6. A tool as defined in claim 7 wherein:

the mounting shoes extend generally parallel to each other in circumferentially spaced apart relation around the peripheral surface of the drum; and the abrasive segments on circumferentially adjacent mounting shoes extend at opposite obtuse angles with respect to each other.

7. A tool as defined in claim 1 wherein: the flat, planar surfaces extend substantially perpendicular to radius lines extending through the longitudinal, central axis of the drum.

8. A tool as defined in claim 4 wherein:

each of the mounting shoes has a plurality of spaced apart slots extending transversely thereof in its top face, and the abrasive segments are mounted in the slots.

9. A tool as defined in claim 8 wherein:

the abrasive segments project outwardly from the mounting shoes in a direction generally perpendicular to the top face of each shoe.

10. A tool as defined in claim 8 wherein:

each of the abrasive segments is secured on top of a base plate, and each base plate is affixed within one of the slots.

11. A tool as defined in claim 1 wherein:

the mounting shoes extend generally parallel to each other in circumferentially spaced apart relation around the peripheral surface of the drum; and the abrasive segments are grouped along the length of each mounting shoe to define open spaces in which said holes are formed to receive the fasteners attached to the drum, and circumferentially adjacent shoes are staggered along the length of the drum in rows with their ends overlapping each other and with abrasive segments on one mounting shoe being circumferentially aligned with an open space on a circumferentially adjacent mounting shoe, to ensure complete abrasive coverage of a surface being worked.

12. A tool as defined in claim 1 wherein:

the mounting shoes are made of metal and the bottom face of each mounting shoe is accurately machined to provide uniform, abutting contact with the flat, planar surface of the metal drum to which it is secured.

13. A tool as defined in claim 1 wherein:

each of said abrasive segments is comprised of diamond chips distributed in a metallic matrix.

14. A tool as defined in claim 1 wherein:

the drum holes are tapped therein to provide machined threads, and the mounting shoes are removably secured to the drum by threaded fasteners extending through said threaded apertures into threaded engagement with the tapped holes in the drum.

* * * * *